US009011157B2

(12) United States Patent
Gunasekaran

(10) Patent No.: US 9,011,157 B2
(45) Date of Patent: Apr. 21, 2015

(54) TOOL ASSISTED PIECE ASSEMBLY IN ENCLOSED CONTAINER

(71) Applicant: Keerthi Gunasekaran, Eden Prairie, MN (US)

(72) Inventor: Keerthi Gunasekaran, Eden Prairie, MN (US)

( * ) Notice: Subject to any disclaimer, the term of this patent is extended or adjusted under 35 U.S.C. 154(b) by 84 days.

(21) Appl. No.: 13/903,086

(22) Filed: May 28, 2013

(65) Prior Publication Data

US 2014/0353206 A1 Dec. 4, 2014

(51) Int. Cl.
*G09B 19/00* (2006.01)
*A45C 11/00* (2006.01)

(52) U.S. Cl.
CPC ..... *A45C 11/00* (2013.01); *Y10T 29/49826* (2015.01)

(58) Field of Classification Search
USPC ..... 434/258–260, 262, 267; 273/440, 447, 273/448
See application file for complete search history.

(56) References Cited

U.S. PATENT DOCUMENTS 2,985,451 A * 5/1961 Sims ..... 273/446
3,276,149 A * 10/1966 Barnabas ..... 434/260
3,479,751 A * 11/1969 Welbourn ..... 434/259
3,484,105 A * 12/1969 Winston ..... 273/440
3,721,440 A * 3/1973 Burns ..... 273/446
4,105,210 A * 8/1978 Jones et al. ..... 273/126 R
4,177,987 A * 12/1979 Zimmerman ..... 273/445
4,412,682 A * 11/1983 Rehkemper et al. ..... 273/447
4,795,351 A * 1/1989 Vermette ..... 434/258
5,028,047 A * 7/1991 Lee et al. ..... 273/447
5,149,270 A * 9/1992 McKeown ..... 434/262
5,194,031 A 3/1993 Sahler
5,295,694 A * 3/1994 Levin ..... 273/447
5,342,064 A * 8/1994 Williamson et al. ..... 273/447
5,403,191 A * 4/1995 Tuason ..... 434/262
5,824,161 A * 10/1998 Atkinson ..... 134/6
5,890,943 A 4/1999 Poulsen et al.
5,947,743 A * 9/1999 Hasson ..... 434/262
6,149,252 A * 11/2000 Browning ..... 312/1
6,609,715 B2 * 8/2003 Anthony ..... 273/447
6,659,776 B1 * 12/2003 Aumann et al. ..... 434/262
6,773,323 B1 8/2004 Huang
6,887,082 B2 * 5/2005 Shun ..... 434/267
7,837,473 B2 * 11/2010 Koh ..... 434/262
8,469,716 B2 * 6/2013 Fedotov et al. ..... 434/267
8,714,664 B2 * 5/2014 Abreu ..... 312/1

* cited by examiner

*Primary Examiner* — Kurt Fernstrom
(74) *Attorney, Agent, or Firm* — William Mitchell IP Clinic

(57) ABSTRACT

Systems and methods for tool assisted piece assembly are generally discussed herein. A system for tool assisted piece assembly may include a container, assembly pieces in the container, and at least one tool. The container may include a transparent portion configured to allow a user to see inside the container and an opening in the container. The at least one tool may be configured to allow a user manipulate the assembly pieces inside the enclosed container with the tool.

11 Claims, 4 Drawing Sheets

TOOL ASSISTED PIECE ASSEMBLY IN ENCLOSED CONTAINER

TECHNICAL FIELD

This disclosure relates generally to instruments, teaching aids, games, or toys, and particularly to manipulative toys and instruments that can engage logical thinking and can help develop motor skills.

BACKGROUND

There are several toys and assistive tools, such instruments can help children and adults to improve their hand-eye coordination and hone their motor skills or logical thinking. Though there are many such available items, there are few, if any, aids, toys, tools, or the like that are engaging, fun, safe, and include levels of increasing complexity. In some examples, a 52 card deck of standard playing cards may be used to teach children and people with disabilities to improve their motor skills and to steady their hand motor skills.

In other cases, several building blocks or shapes of varying dimensions can help children build a small assembly or structure either purely out of the person's imagination or with some external guidance, such as a user's manual or building instructions. In the case of building blocks, the smaller they are the better they may promote fine motor skill and dexterity training. However, the smaller the blocks the easier it can be to lose the blocks. In addition, smaller blocks may potentially create a choking hazard, such as for younger people. This may lead to an unsafe environment and a concern for the person using the assembly blocks. Larger blocks may tend to get lost or misplaced gradually and take up more space than smaller assembly blocks.

SUMMARY

An example of a system configured to conduct tool assisted piece assembly in an enclosed container can include a container, wherein the container includes at least one transparent portion configured to allow a user to see inside the container. The system can include at least two assembly pieces disposed within the container, an assembly piece of the at least two assembly pieces including at least one first connection feature, the at least one first connection feature configured to mechanically couple to at least one second connection feature of another assembly piece of the at least two assembly pieces. The system can include at least one tool, wherein the at least one tool is configured to allow a user to manipulate at least one of the at least two assembly pieces using the at least one tool, and wherein the container is configured to allow the at least one tool to contact, directly or indirectly, at least one of the at least two assembly pieces in the container.

An example of a technique for tool assisted piece assembly can include manipulating first and second assembly pieces situated in a container using a tool situated at least partially outside the container, and coupling a first assembly piece to a second assembly piece using the tool.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various examples discussed in the present document. The drawings are intended to illustrate, such as through block diagrams, examples of aspects of the present disclosure.

Figures 1A, 1B, 1C, 1D, 1E, 1F, 1G:
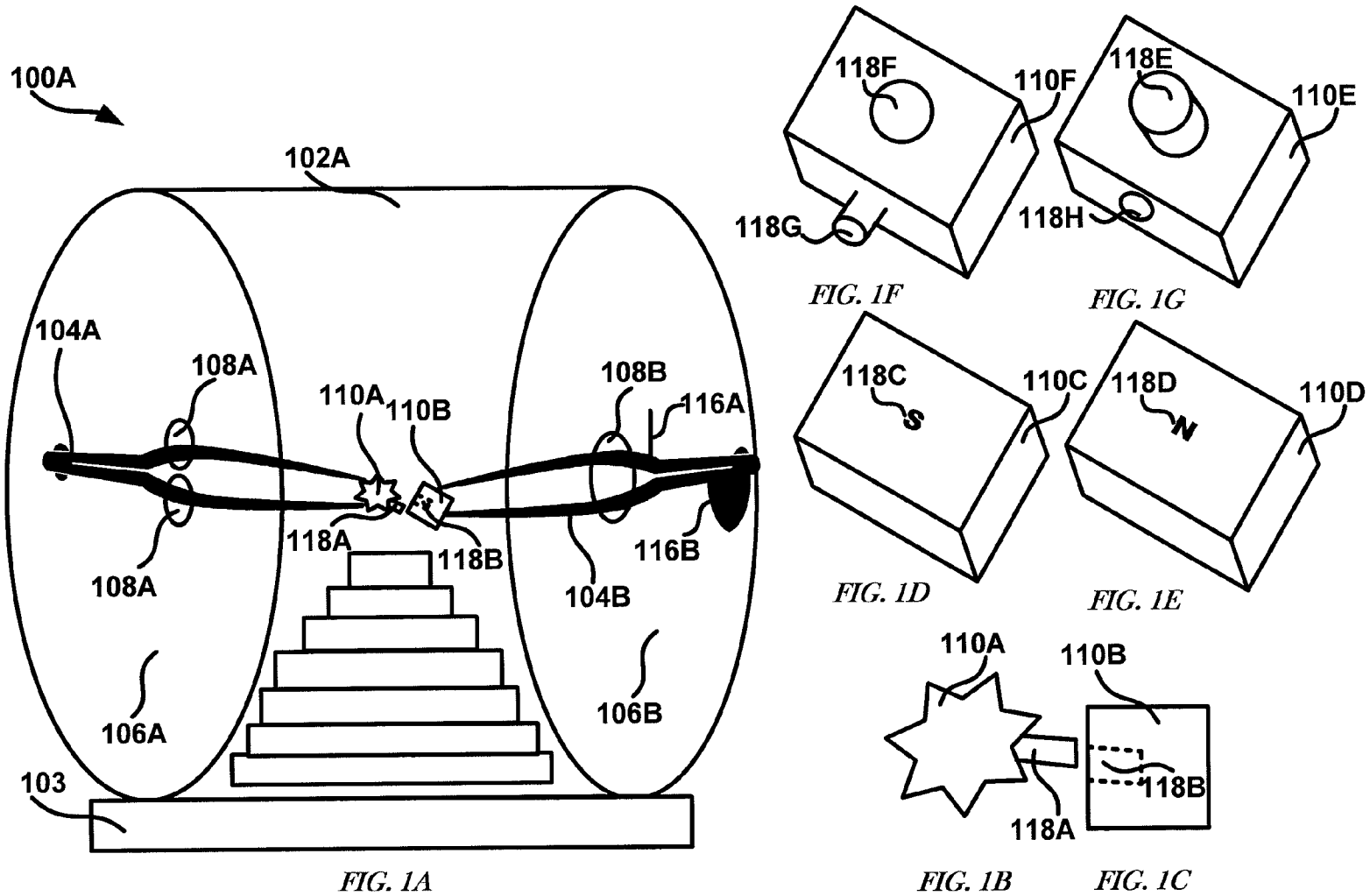
FIG. 1A is a block diagram of an example of a tool assisted piece assembly system.
FIG. 1B is a perspective view diagram of an example of assembly pieces.
FIG. 1C is a perspective view diagram of another example of assembly pieces.
FIG. 1D is a perspective view diagram of another example of assembly pieces.
FIG. 1E is a perspective view diagram of another example of assembly pieces.
FIG. 1F is a perspective view diagram of another example of assembly pieces.
FIG. 1G is a perspective view diagram of yet another example of assembly pieces.

In the FIGS. and description herein, the following reference numbers represent the corresponding item.

100, 100A, 100B, and 100C are systems.

102 is a container.

104, 104A, and 104B are manipulative tools.

106, 106A, and 106B are sides.

108, 108A, and 108B are openings.

110, 110A, 110B, 110C, 110D, 110E, and 110F are pieces.

112, 112A, and 112B are attachable or detachable portions.

114, 114A, and 114B are flexible membranes.

116, 116A, and 116B are protrusions.

118, 118A, 118B, 118C, 118D, 118E, 118F, 118G, and 118H are connection features.

320 is an extension.

402 and 404 represent a technique for tool assisted piece assembly in a container.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the teaching of the disclosure, and it is to be understood that other embodiments may be utilized and that structural, logical and electrical changes may be made without departing from the scope of the present disclosure. The following description of embodiments is, therefore, not to be taken in a limited sense, and the scope of the present disclosure is defined by the appended claims.

Systems and methods for tool assisted piece assembly are generally discussed herein. These systems may help people build or improve their fine motor skills, dexterity, or logical thinking. The logical thinking can be improved through solving how to build a structure given the constraints of assembling pieces without any direct contact with the pieces situated in a closed container therein. The person's manipulative skills may be enhanced in a tool assisted piece assembly through which child or an adult can use one or more tools to construct a structure inside a container out of their imagination or with some guidance (e.g., using an instruction manual). Using the tool(s) may make assembling pieces more challenging or fun and can facilitate logical reasoning.

A system for tool assisted piece assembly in an enclosed container may include a container, assembly pieces in the container, and at least one manipulation tool. The container may include a transparent portion configured to allow a user to see inside the container. The container can be shaped in several forms, such as to include a three-dimensional polygon-shaped portion (e.g., a box-shaped portion or a pyramid-shaped portion), a three-dimensional ellipse-shaped portion (e.g., a sphere-shaped portion or a cone-shaped portion), other shaped portion, a combination thereof, or any other three dimensional at least partially hollow shapes. The system can include at least one manipulation tool that may be configured to allow a user to manipulate (e.g., pick up, rotate, push, or assemble) the assembly pieces. The container can have an opening in the side or on the surface of the container to allow a manipulation tool to penetrate the container, while not allowing the tool to be disposed entirely within the container. A portion of the container can include a flexible membrane made of rubber, silicone, or similar materials.

One can use a manipulation tool from outside the container to manipulate the pieces inside the container without directly contacting the pieces. This can allow the container to be free of any openings or holes sufficiently large to allow a piece to escape the container. Another way to achieve manipulation of the pieces is to include a manipulation tool that includes one or more magnets on inside and outside the container. In such a configuration, the manipulation tool can include one or magnets on one end contacting the surface of the container while situated inside the container. From the outside surface of the container, magnets with opposite polarity can be magnetically coupled to the magnets inside the container. Manipulation of the blocks can be achieved by moving the magnets outside of the container. In such instances, the container can be made of one or more thin materials, such as polycarbonate, that can allow a magnetic field to permeate the material.

The assembly pieces can range from simple inactive cubes, gears, asymmetrical parts and shapes, to one or more electric or electronic components, such as batteries, resistors, capacitors, transistors, which can be arranged in patterns or circuits to provide a combined structure or function.

Figure 2:
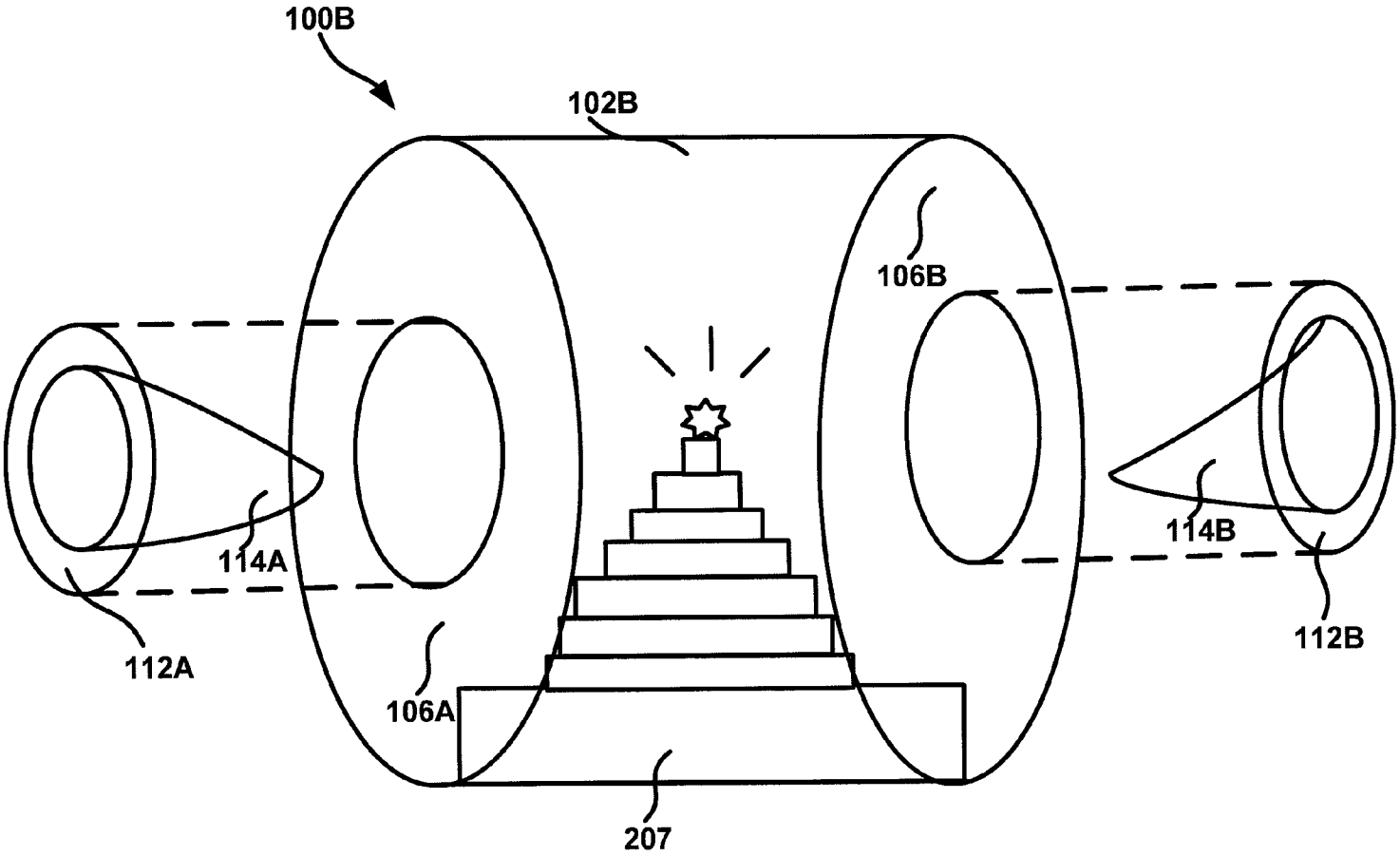
FIG. 2 is a block diagram of an example of a tool assisted piece assembly system.
Figure 3:
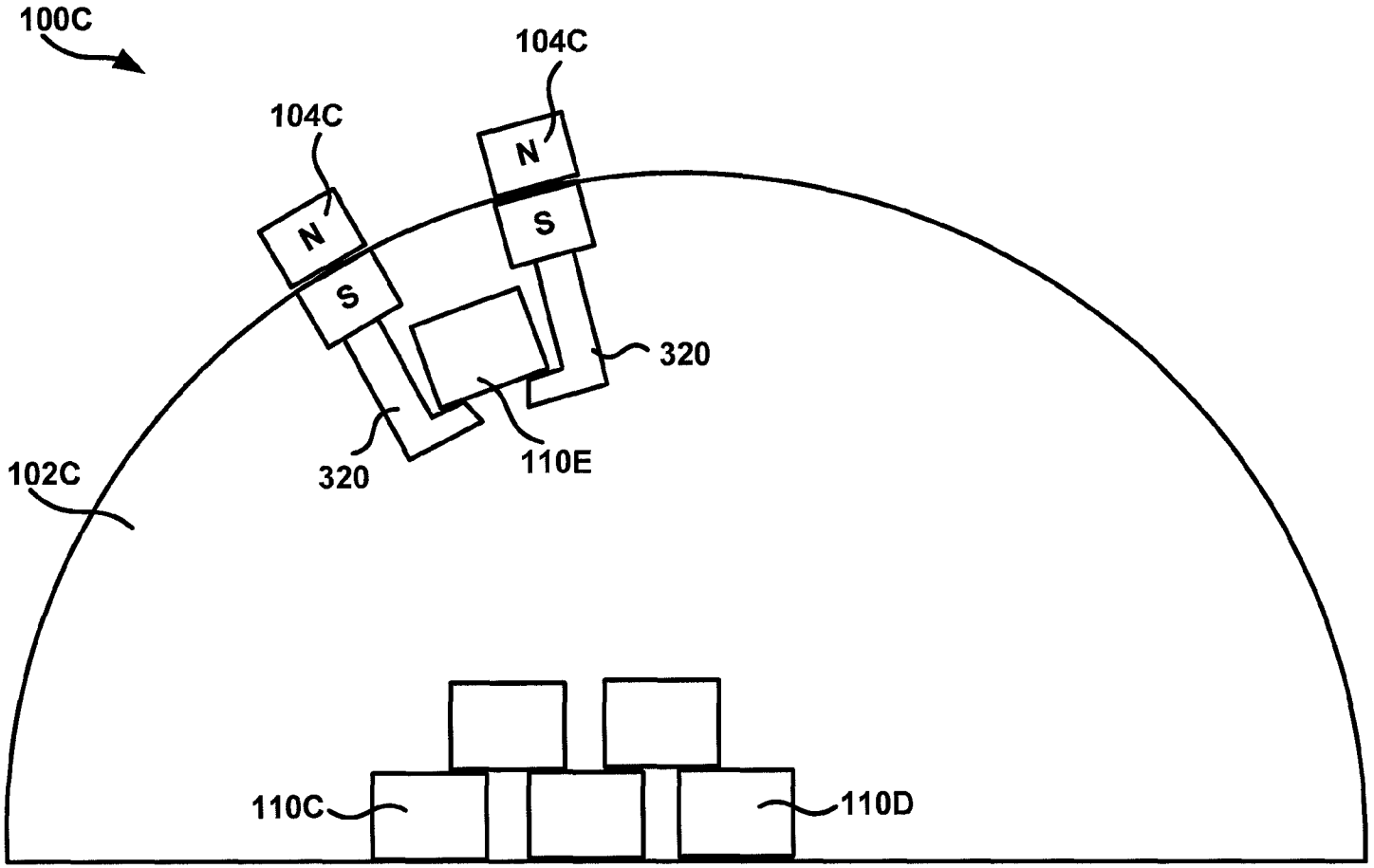
FIG. 3 is a block diagram of an example of a tool assisted piece assembly system.

FIGS. 1-3 show block diagrams of systems 100A, 100B, and 100C for manipulation tool 104 assisted piece 110 assembly in an enclosed container 102. The system 100 includes a container 102, an optional base 103 (e.g., a support structure), an optional platform 207 (e.g., a structure internal to the container configured to provide a surface to build structures with the assembly pieces 110A-B on) (see FIG. 2), at least one manipulation tool 104A-B, and multiple assembly pieces 110A-B.

The container 102 may house assembly pieces 110 or the container 102 may be configured to allow the assembly pieces 110 to be removed or inserted therein, such as through an end-user attachable or detachable portion 112A-B. The container 102 may include at least one portion that is at least partially transparent, such as to allow a user to see into the container 102. The container 102 may include a first side 106A, a second side 106B, and a portion connecting the first side 106A to the second side 106B, such as shown in FIG. 1. The container 102 may include a cylinder-shaped portion, such as shown in FIGS. 1-2, a three-dimensional polygon-shaped portion, such as a box-shaped portion or a pyramid-shaped portion, a three-dimensional ellipse-shaped portion, such as a sphere-shaped portion, a cone-shaped portion, other shaped portion, or a combination thereof The system 100 may include a base 103. The container 102 can be configured to be situated on the base 103 or the base can be configured to have the container situated thereon. The base 103 can provide structural support for the container 102, such as to allow a user to manipulate pieces 110 without the container wandering (e.g., with the container 102 remaining in place).

The container 102 may include at least one opening 108A-B there through or therein, depending on the type of manipulation tool 104 used or the type of connection feature 118 included in the assembly pieces 110. The opening 108 may be configured to allow the tool 104 to penetrate or pass through the opening 108. The opening 108 may be in a side of the container 102, such as in the first or second side 106A-B of the container, such as shown in FIG. 1, or may be in another location on the container 102. The opening 108 may be configured to allow the tool 104 to only partially penetrate the container 102, such as to prevent the tool 104 from being disposed entirely within the container 102, while still allowing the tool 104 to assist a user in manipulating the pieces 110. Such a configuration may include multiple openings 108 configured to only allow a portion of the tool 104 to penetrate the container 102, it can also include a hole smaller than one end of the tool 104 preventing it from being disposed entirely within the container such as shown in FIG. 1.

The optional first and second sides 106A-B may include portions that are at least partially transparent, such as to allow a user to see inside the container 102.

The manipulation tool 104A-B may be operable to assist a user in manipulating, for example mechanically, ferrously (e.g., magnetically), or electrically coupling, or a combination thereof, or tweezing the pieces 110. The at manipulation tool 104 may be a tweezers or pincer. More than one tool can be included in the system, such as shown in FIG. 1. The tool 104 may be configured to only partially penetrate the opening 108A-B in the container 102, such as by including a protrusion 116A or 116B on the tool 104B, such as shown in FIG. 1, or otherwise sizing or shaping the tool 104 such that it cannot fit entirely into the container 102 by entering the container 102 through the opening 108. The at least one tool 104A-B may be magnetic so as to allow the tool 104A-B to attract or repel ferrous or magnetic assembly pieces 110, such as shown in FIG. 3.

The assembly pieces 110 (e.g., assembly blocks) may be configured to include at least one mechanical (e.g., pin, pin-hole) or magnetic(e.g., North-South polarity based mating)or electrical (e.g., resistor legs, through hole circuit board)connection feature 118A,which can mate or be attached with a similar or pairing connection feature of another assembly piece 118B. A connection feature 118 may include a dowel, dowel hole, socket, socket hole, screw, screw hole, tab, magnet, or other feature capable of allowing the connection feature to be mechanically, magnetically, or electrically coupled to another connection feature 118. The connection feature 118 may allow a user to connect at least two pieces 110 together, such as by connecting the connection feature 118A of one piece 110A to a mating connection feature 118B of another piece 110B. By having more than one connection feature 118 in the piece 110, multiple pieces can be connected together to form assemblies, patterns, or circuits.

The pieces 110 may include electrical or electronic components, such as resistors, batteries, inductors, wires, capacitors, chips, transistors, light emitting elements, sound emitting elements, solderless breadboard, or plug board etc., such that when the pieces 110 are assembled in a certain way, for example, when the connection feature 118A is coupled to connection feature 118B, the electric or electronic components create a closed circuit. The pieces 110 may include plastic, other polymers, metal, wood, ceramic, ferrous materials, or other material operable to mechanically couple to a connection feature 118 of one another and retain, at least partially, its shape. The pieces 110 may include a variety of shapes and sizes, such as ellipses, polygons, "star" shapes, three-dimensional versions of such shapes, irregular shapes, or combinations thereof, among others, including gears, cogs, wheels, or the like. The pieces 110 may be individually shaped and sized and individually made from different materials or combinations of materials. The system 100 can include a themed set of pieces 110 in the container, such as to spark the interest and engagement of the person interacting with the pieces 110 in the container.

The container 102 may include at least one attachable or detachable portion 112A-112B configured to be removed from or attached to the container 102, for example, an end-user attachable or detachable portion, as can be seen in FIG. 2. The attachable or detachable portion 112A-112B may include at least one opening 108. The attachable or detachable portion may include a flexible membrane 114. The attachable or detachable portion 112A-112B may be configured to allow a user to remove pieces 110 from or place pieces 110 into the container 102 after the attachable or detachable portion 112A-112B is removed from the container 102. The attachable or detachable portion 112 may be connected via a snap fit or may be mechanically joined, such as by being screwed onto/into the surface of the container 102. The ability to add or remove pieces is optional.

The container 102 may include at least one flexible membrane 114A-B attached thereto. The flexible membrane 114 may be made of material, such as rubber, plastic, latex, or other flexible polymer, operable to allow a user to manipulate (e.g., tweeze) an assembly piece 110 with the tool 104 when the flexible membrane 114 is between the tool 104 and the piece 110. The flexible membrane 114 may be mechanically coupled to the attachable or detachable portion 112A-112B or the opening 108, such as shown in FIG. 2.

FIGS. 1B, 1C, 1D, 1E, 1F, and 1G are block diagrams of various assembly pieces 110 and connection features 118. FIG. 1B and FIG. 1C are magnified view diagrams of pieces 110A-B from FIG. 1A. Piece 110A can include a connection feature 118A configured to mate with the connection feature 118B of piece 110B. The connection feature 110A can include a screw, dowel, pin, or the like. The connection feature 110B can include a screw hole, dowel hole, pin hole, or the like. FIG. 1D and FIG. 1E are diagrams of north and south polarized magnetic pieces 110D and 110C, respectively. The connection feature 118C of piece 110C can include a magnetic material with a south polarity. The connection feature 118D of piece 110D can include a magnetic material with a north polarity. FIG. 1F and FIG. 1G are diagrams of pieces 110E and 110F that each includes multiple connection features 118C and 118F, and 118E and 118H, respectively. Connection feature 118C can be configured to mate with connection feature 118H and connection feature 118E can be configured to mate with connection feature 118F. Including pieces 110 that include multiple connection features can facilitate connecting multiple pieces 110 to the same piece 110. The assembly piece 110E can include a connection feature 118E (e.g., a male connection feature) and the assembly piece 110F can include a mating connection feature 118F (e.g., a female connection feature). The connection feature 118E-F of the assembly piece 110E-F may be caused to extend or retract from or into its associated assembly piece 100E-F by placing the tool 104 near the assembly piece 110E-F and rotating the tool 104 or gripping or otherwise contacting the connection feature 118 with the tool 104 to cause the connection feature to extend or retract.

FIG. 3 shows a block diagram of an example of a system 100C configured for tool 104 assisted piece 110 assembly in an enclosed container 102C. In this example, a ferrous tool 104C is partially external and partially internal to a container 102C.The part of the ferrous tool 104C external to the container 102 can be of a first polarity and a part of the ferrous tool 104C internal to the container 102 can be of a second, opposite polarity. The ferrous tool 104C can include an extension 320 configured to facilitate a user picking up or otherwise moving a piece 110C-E.

The container 102 can be substantially air tight so as to allow the container to carry a fluid, such as water or other fluid. In such embodiments, the container may not include an opening 108 or flexible membrane 114 so as to help prevent fluid displacement.

Figure 4:
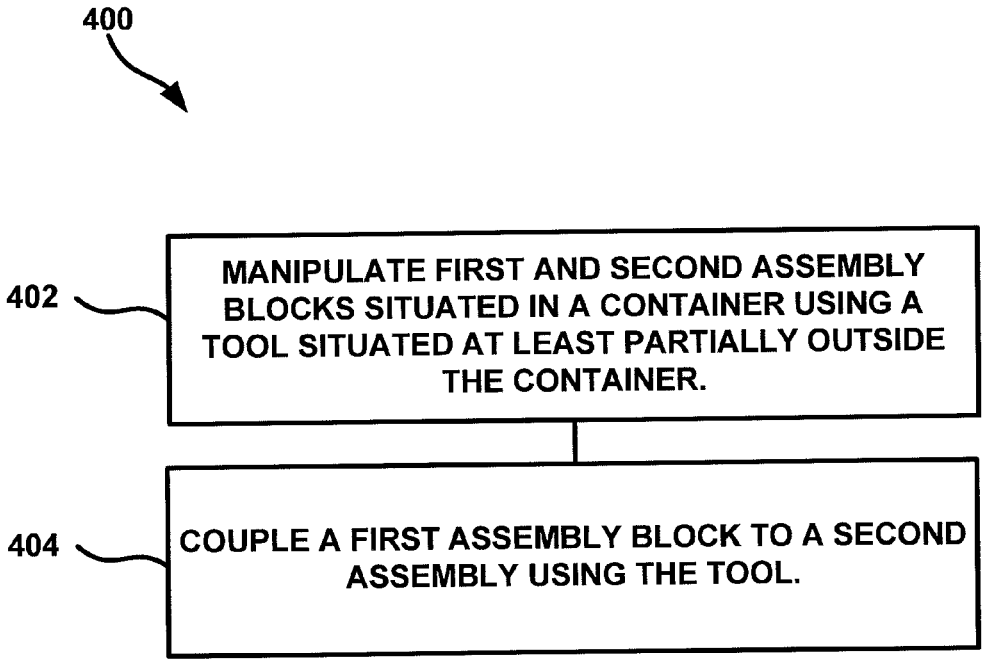
FIG. 4 shows an example of a technique of using a tool assisted piece assembly.

FIG. 4 shows an example of a technique 400 of assembling pieces 110 in a tool 104 assisted piece 110 assembly 100. At 402, a first assembly piece 110A may be coupled, electrically, mechanically, or magnetically to a second assembly piece 110B. The first and second assembly pieces 110A-B may be contained with a container 102 that includes an opening 108. At 404, the first and second assembly pieces 110 may be coupled (e.g., electrically, mechanically, or magnetically coupled) by tweezing the assembly pieces 110 through a flexible membrane 114 coupled to the container. An end portion of the flexible membrane 114 may be at least partially concentric with or may at least partially overlap the opening, as seen in FIG. 2. The first assembly piece 110A may be tweezed or otherwise picked up using a first tool 104A and may then be electrically, mechanically, or magnetically coupled to the second assembly piece 110B. The second assembly piece may be tweezed or otherwise manipulated using a second tool 104B. The tweezing may be accomplished by using the tools 104A-B at least partially within the container 102.

Additional Notes and Examples

In Example 1, a system for tool assisted piece assembly in a container includes a container, wherein the container can include at least one transparent portion configured to allow a user to see inside the container.

In Example 2, the system of Example 1 can include at least two assembly pieces disposed within the container, an assembly piece of the at least two assembly pieces including at least one connection feature, the at least one connection feature configured to mechanically couple the at least two assembly pieces with one another.

In Example 3, the system of at least one of Examples 1-2 can include at least one tool, wherein the at least one tool is configured to allow a user to manipulate at least one of the at least two assembly pieces using the at least one tool, and wherein the container is configured to allow the at least one tool to contact, directly or indirectly, at least one of the at least two assembly pieces in the container.

In Example 4, the container of at least one of Examples 1-3 includes a first opening in a first side of the container and wherein the container includes a second opening in a second side of the container, the second side of the container opposite the first side of the container.

In Example 5, the first and second openings of at least one of Examples 1-4 are sized so as to prevent at least one (e.g., any) of the at least two assembly pieces from escaping the container.

In Example 6, the at least one tool of at least one of Examples 1-5 includes at least one magnet.

In Example 7, the container of at least one of Examples 1-6 includes at least one flexible membrane attached around an opening in the container, the at least one flexible membrane configured to allow the at least one tool to manipulate the assembly piece when the at least one flexible membrane is located between the tool and the assembly piece.

In Example 8, the at least one tool of at least one of Examples 1-7 is chosen from the group including a tweezers and a pincer.

In Example 9, the container of at least one of Examples 1-8 includes an end-user attachable or detachable portion configured to allow a user to situate assembly pieces in or remove the assembly pieces from the container when the end-user attachable or detachable portion is removed from the container.

In Example 10, the connection feature of the assembly piece of at least one of Examples 1-9 includes at least one of a pin, screw, magnet, or a tab.

In Example 11, the connection feature of the assembly piece of at least one of Examples 1-10 is ferrous.

In Example 12, the system of at least one of Examples 1-11 includes a platform, wherein the platform is contained within the container and configured to provide a surface to rest an assembly piece of the assembly pieces on.

In Example 13 a technique for tool assisted piece assembly in an enclosed container includes manipulating the first and or second assembly pieces situated in a container using a tool situated at least partially outside the container, and coupling a first assembly piece to a second assembly piece using the tool.

In Example 14, the coupling of the first assembly piece to the second assembly piece of at least one of Examples 1-13 includes tweezing, using a tweezers or pincer.

In Example 15, the tweezing, using the tweezers of at least one of Examples 1-14 includes tweezing the first assembly piece through a flexible membrane coupled to a side of the container when the flexible membrane is between the first assembly piece and the tweezers.

In Example 16, the coupling the first assembly piece to the second assembly piece of at least one of Examples 1-15 includes mechanically coupling, using the first and second tools, the first assembly piece to the second assembly piece.

In Example 17, the tweezing of at least one of Examples 1-16 includes tweezing the first assembly piece through the first opening in the first side of the container using the first tool and tweezing, using the second tool, the second assembly piece through a second opening in a second side of the container opposite the first side of the container.

In Example 18, tweezing, using the tweezers of at least one of Examples 1-17 includes tweezing the first assembly piece through a first flexible membrane coupled to a first side of the container and tweezing the second assembly piece through a second flexible membrane coupled to a second side of the container.

In Example 19, the technique of at least one of Examples 1-18 includes removing an end-user attachable or detachable portion of the container from the container or attaching the end-user attachable or detachable portion of the container to the container.

In Example 20, the coupling of the first assembly piece to the second assembly piece of at least one of Examples 1-19 includes connecting a connection feature of the first assembly piece to a mating connection feature of the second assembly piece.

In Example 21, coupling the first assembly piece to the second assembly piece of at least one of Examples 1-20 includes mechanically coupling a metal connection feature of the first assembly piece to a mating connection feature of the second assembly piece.

In Example 22, coupling the first assembly piece to the second assembly piece of at least one of Examples 1-21 includes ferrously coupling a magnetic connection feature of the first assembly piece to the mating magnetic connection feature of the second assembly piece.

In Example 23a system may include at least two assembly pieces, the at least two assembly pieces including a first and a second assembly piece, the first assembly piece that includes a connection feature and the second assembly piece that includes a mating connection feature configured to couple to the connection feature of the first assembly piece, where the connection feature of the first assembly piece includes at least one of a pin, screw, magnet, or a tab, and the mating connection feature of the second assembly piece is plastic, metal, or a combination thereof. The system of Example 23 may include first and second tweezers, wherein the first and second tweezers may be configured to allow a user to manipulate the at least two assembly pieces by engaging or operating the first and second tweezers. The system of Example 23 may include a container, wherein the container includes a first transparent portion configured to allow a user to see inside the container, a first opening in the first side of the container, the first opening sized and shaped so as to prevent the at least two assembly pieces from entirely escaping the container when the at least two assembly pieces are in the container, and the first opening configured to allow the first tweezers to contact, directly or indirectly, the at least two assembly pieces when they are in the container and a second opening in a second side of the container, the second side opposite the first side, the second opening sized and shaped so as to prevent the at least two assembly pieces from entirely escaping the container when at least one of the at least two assembly pieces are in the container, and the second opening configured to allow the second tweezers to contact, directly or indirectly, at least one of the at least two assembly pieces when they are in the container. The container of Example 23 may include first and second flexible membranes, the first and second flexible membranes configured to allow a first or second tweezers to tweeze the first assembly piece when at least one of the flexible membranes is between the first or second tweezers and the first assembly piece, the first flexible membrane attached around the first opening, and the second flexible membrane attached around the second opening, and the system may include an end-user attachable or detachable portion configured to allow a user to situate the first or second assembly piece in, or remove the first or second assembly piece from, the container when the end-user attachable or detachable portion is removed from the container.

The above detailed description comprises references to the accompanying drawings, which form a part of the detailed description. The drawings show, by way of illustration, specific embodiments in which the disclosure may be practiced. These embodiments are also referred to herein as "examples." Such examples may comprise elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to comprise one or more than one, independent of any other instances or usages of "at least one" or "one or more." In this document, the term "or" is used to refer to a nonexclusive or, such that "A or B" comprises "A but not B," "B but not A," and "A and B," unless otherwise indicated. In this document, the terms "comprising" and "in which" are used as the plain English equivalents of the respective terms "comprising" and "wherein." Also, in the following claims, the terms "comprising" and "wherein" are open-ended, that is, a system, device, article, composition, formulation, or process that comprises elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments may be combined with each other in various combinations or permutations. The scope of the disclosure should be determined with reference to the appended claims, along with the full scope of equivalents to which such claims are entitled.

What is claimed is:

1. A system comprising:

a container, wherein the container includes at least one transparent portion configured to allow a user to see inside the container;

at least two assembly pieces disposed within the container, wherein a first assembly piece includes a mating connection feature configured to couple the first assembly piece with a second assembly piece; and a manipulation tool comprising:

a first part disposed outside the container with a first magnet attached to thereto; and a second part disposed inside the container with a second magnet attached thereto, wherein the second magnet has the opposite polarity of the first magnet, wherein the magnets are configured to be magnetically coupled together to enable the second part to traverse on the inside surface of the container by moving the first part on the outer surface of the container.

2. The system of claim 1, wherein the second part of the manipulation tool includes a tweezers or a pincer.

3. The system of claim 1, wherein the container includes an end-user attachable or detachable portion configured to allow a user to situate the at least two assembly pieces in or remove the at least two assembly pieces from the container when the end-user attachable or detachable portion is detached from the container.

4. The system of claim 1, wherein the mating connection feature is a pin, a screw, a magnet, or a tab.

5. The system of claim 4, wherein the mating connection feature is ferrous.

6. The system of claim 1, wherein the system includes a platform, wherein the platform resides in the container and is configured to provide a surface to support a structure built in the container.

7. The system of claim 1, wherein the container is airtight so that the container can be filled with a fluid.

8. A system comprising:

at least two assembly pieces, the at least two assembly pieces including a first and a second assembly piece, the first assembly piece including a connection feature and the second assembly piece including a mating connection feature configured to couple to the connection feature of the first assembly piece, the connection feature of the first assembly piece including at least one of a pin, screw, magnet, or a tab;

first and second tweezers, wherein the first and second tweezers are configured to allow a user to manipulate the at least two assembly pieces with the first and second tweezers; and a container, wherein the container includes:

a first transparent portion configured to allow a user to see inside the container;

a first opening in a first side of the container, the first opening sized and shaped so as to prevent the at least two assembly pieces from escaping the container when the at least two assembly pieces are situated in the container, and the first opening configured to allow the first tweezers to contact, directly or indirectly, at least one of the at least two assembly pieces when they are in the container;

a second opening in a second side of the container, the second side opposite the first side, the second opening sized and shaped so as to prevent the at least two assembly pieces from escaping the container when the at least two assembly pieces are in the container, and the second opening configured to allow the second tweezers to contact, directly or indirectly, at least one of the at least two assembly pieces when they are in the container;

first and second flexible membranes, the first and second flexible membranes configured to allow a first or second tweezers to tweeze the first assembly piece when the first or second flexible membrane is between the first or second tweezers and the first assembly piece, and the first flexible membrane attached around the first opening, and the second flexible membrane attached to the second opening; and an end-user attachable or detachable portion configured to allow a user to situate the first or second assembly piece in, or remove the first or second assembly piece from, the container when the end-user attachable or detachable portion is removed from the container.

9. A system comprising:

a container, wherein the container includes a transparent portion configured to allow a user to see inside the container;

at least two assembly pieces disposed within the container, wherein a first assembly piece includes a mating connection feature configured to couple the first assembly piece with a second assembly piece, wherein the mating connection is a pin, a screw, a magnet, or a tab;

a manipulation tweezers comprising:

a handle part disposed outside the container with a first magnet attached to thereto; and a tweezing part disposed inside the container with a second magnet attached thereto, wherein the second magnet has the opposite polarity of the first magnet, wherein the magnets are configured to be magnetically coupled together to enable the tweezing part to traverse on the inside surface of the container by moving the handle part on the outer surface of the container; and an end-user attachable or detachable portion configured to allow a user to situate the at least two assembly pieces in, or remove the at least two assembly pieces from, the container when the end-user attachable or detachable portion is detached from the container.

10. The system of claim 1 or 9, wherein an assembly piece includes a resistor, a battery, an inductor, a wire, a capacitor, transistor, a light emitting element, or a sound emitting element.

11. The system of claim 10, further comprising:

a solderless breadboard or a plug board is disposed in the container, configured to accept an assembly piece.

* * * * *